US011264699B2

(12) United States Patent
Chang et al.

(10) Patent No.: US 11,264,699 B2
(45) Date of Patent: Mar. 1, 2022

(54) ANTENNA STRUCTURE AND MOBILE DEVICE

(71) Applicant: Wistron NeWeb Corp., Hsinchu (TW)

(72) Inventors: Cheng-Pang Chang, Hsinchu (TW); Shih-Hsien Tseng, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 228 days.

(21) Appl. No.: 16/658,353

(22) Filed: Oct. 21, 2019

(65) Prior Publication Data

US 2020/0185813 A1 Jun. 11, 2020

(30) Foreign Application Priority Data

Dec. 7, 2018 (TW) ..... 107144086

(51) Int. Cl.

| | |
|---|---|
| ***H01Q 1/24*** | (2006.01) |
| ***H01Q 1/22*** | (2006.01) |
| ***H01Q 1/48*** | (2006.01) |
| ***H01Q 9/42*** | (2006.01) |
| ***H01Q 9/40*** | (2006.01) |

(52) U.S. Cl.

CPC ..... *H01Q 1/2266* (2013.01); *H01Q 1/2291* (2013.01); *H01Q 1/48* (2013.01); *H01Q 9/40* (2013.01); *H01Q 9/42* (2013.01)

(58) Field of Classification Search

None

See application file for complete search history.

(56) References Cited

U.S. PATENT DOCUMENTS

| | | | | |
|---|---|---|---|---|
| 10,056,696 | B2 * | 8/2018 | Tseng | H01Q 13/106 |
| 10,297,907 | B2 * | 5/2019 | Chen | H01Q 1/243 |
| 2013/0113671 | A1 | 5/2013 | Su et al. | |
| 2015/0118710 | A1 * | 4/2015 | Govindappa | C12P 21/02 435/69.4 |
| 2016/0049719 | A1 * | 2/2016 | Tseng | H01Q 5/371 343/702 |
| 2017/0005414 | A1 * | 1/2017 | Yang | H01Q 5/378 |
| 2017/0033467 | A1 * | 2/2017 | Huang | H01Q 5/357 |

(Continued)

FOREIGN PATENT DOCUMENTS

| | | | |
|---|---|---|---|
| TW | 201320468 | A1 | 5/2013 |
| TW | 201703350 | A | 1/2017 |

*Primary Examiner* — Trinh V Dinh

(74) *Attorney, Agent, or Firm* — McClure, Qualey & Rodack, LLP

(57) ABSTRACT

An antenna structure includes a metal mechanism element, a ground element, a first radiation element, a second radiation element, and a dielectric substrate. The metal mechanism element has a slot. A notch is formed on an edge of the metal mechanism element. The notch and the slot are connected to each other. The ground element is coupled to the metal mechanism element. The first radiation element has a feeding point. The second radiation element is coupled to the first radiation element and includes a first extension portion. The second radiation element extends across the slot. The first extension portion is parallel to the slot. A vertical projection of the first extension portion at least partially overlaps the slot. The dielectric substrate is adjacent to the metal mechanism element. The first radiation element and the second radiation element are disposed on the dielectric substrate.

20 Claims, 8 Drawing Sheets

(56) References Cited

U.S. PATENT DOCUMENTS

| | | | | |
|---|---|---|---|---|
| 2017/0207542 | A1* | 7/2017 | Tseng | H01Q 13/106 |
| 2017/0250475 | A1* | 8/2017 | Liu | H01Q 1/243 |
| 2018/0026341 | A1* | 1/2018 | Mow | H04B 10/90 343/702 |
| 2019/0027811 | A1* | 1/2019 | Chen | H04M 1/26 |

* cited by examiner

ANTENNA STRUCTURE AND MOBILE DEVICE

CROSS REFERENCE TO RELATED APPLICATIONS

This application claims priority of Taiwan Patent Application No. 107144086 filed on Dec. 7, 2018, the entirety of which is incorporated by reference herein.

BACKGROUND OF THE INVENTION

Field of the Invention

The disclosure generally relates to an antenna structure, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In an exemplary embodiment, the disclosure is directed to an antenna structure including a metal mechanism element, a ground element, a first radiation element, a second radiation element, and a dielectric substrate. The metal mechanism element has a slot. A notch is formed on an edge of the metal mechanism element. The slot is exposed from the edge through the notch. The ground element is coupled to the metal mechanism element. The first radiation element has a feeding point. The second radiation element is coupled to the first radiation element and includes a first extension portion. The second radiation element extends across the slot. The first extension portion is parallel to the slot. The first extension portion has a vertical projection on the metal mechanism element. The vertical projection of the first extension portion at least partially overlaps the slot. The dielectric substrate is adjacent to the metal mechanism element. The first radiation element and the second radiation element are disposed on the dielectric substrate.

In some embodiments, the metal mechanism element is a sidewall of a mobile device.

In some embodiments, the mobile device is a notebook computer.

In some embodiments, the slot substantially has a straight-line shape.

In some embodiments, the slot is a closed slot with a first closed end and a second closed end.

In some embodiments, the ground element is a ground copper foil extending from the metal mechanism element onto the dielectric substrate.

In some embodiments, the first radiation element substantially has a straight-line shape.

In some embodiments, the first radiation element has a variable-width structure.

In some embodiments, the first radiation element comprises a narrow portion and a wide portion. The wide portion has a vertical projection on the metal mechanism element, and the vertical projection of the wide portion at least partially overlaps the slot.

In some embodiments, the second radiation element substantially has an L-shape.

In some embodiments, the antenna structure further includes a third radiation element coupled to the first radiation element. The third radiation element extends across the slot and includes a second extension portion. The second extension portion is parallel to the slot. The second extension portion has a vertical projection on the metal mechanism element, and the vertical projection of the second extension portion at least partially overlaps the slot.

In some embodiments, the third radiation element substantially has an L-shape.

In some embodiments, the second radiation element and the third radiation element substantially extend in opposite directions.

In some embodiments, the third radiation element has a vertical projection on the edge of the metal mechanism element, and the vertical projection of the third radiation element at least partially overlaps the notch.

In some embodiments, the antenna structure operates in a first frequency band and a second frequency band. The first frequency band is from 2400 MHz to 2500 MHz. The second frequency band is from 5150 MHz to 5850 MHz.

In some embodiments, a first distance is defined between the notch and the first closed end of the slot. The first distance is substantially equal to 0.25 wavelength of the first frequency band.

In some embodiments, a second distance is defined between the notch and the second closed end of the slot. The second distance is substantially equal to 0.25 wavelength of the second frequency band.

In some embodiments, the width of the notch is from 1 mm to 3 mm.

In another exemplary embodiment, the disclosure is directed to a mobile device including a body, a metal mechanism element, a ground element, a first radiation element, a second radiation element, and a dielectric substrate. The body includes a frame and a housing. The metal mechanism element is coupled between the frame and the housing. The metal mechanism element has a slot. A notch is formed on an edge of the metal mechanism element. The slot is exposed from the edge through the notch. The ground element is coupled to the metal mechanism element. The first radiation element has a feeding point. The second radiation element is coupled to the first radiation element. The second radiation element extends across the slot. The dielectric substrate is adjacent to the metal mechanism element. The first radiation element and the second radiation element are disposed on the dielectric substrate. An antenna structure is formed by the metal mechanism element, the ground element, the first radiation element, the second radiation element, and the dielectric substrate.

In some embodiments, an antenna window is opened on the housing.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
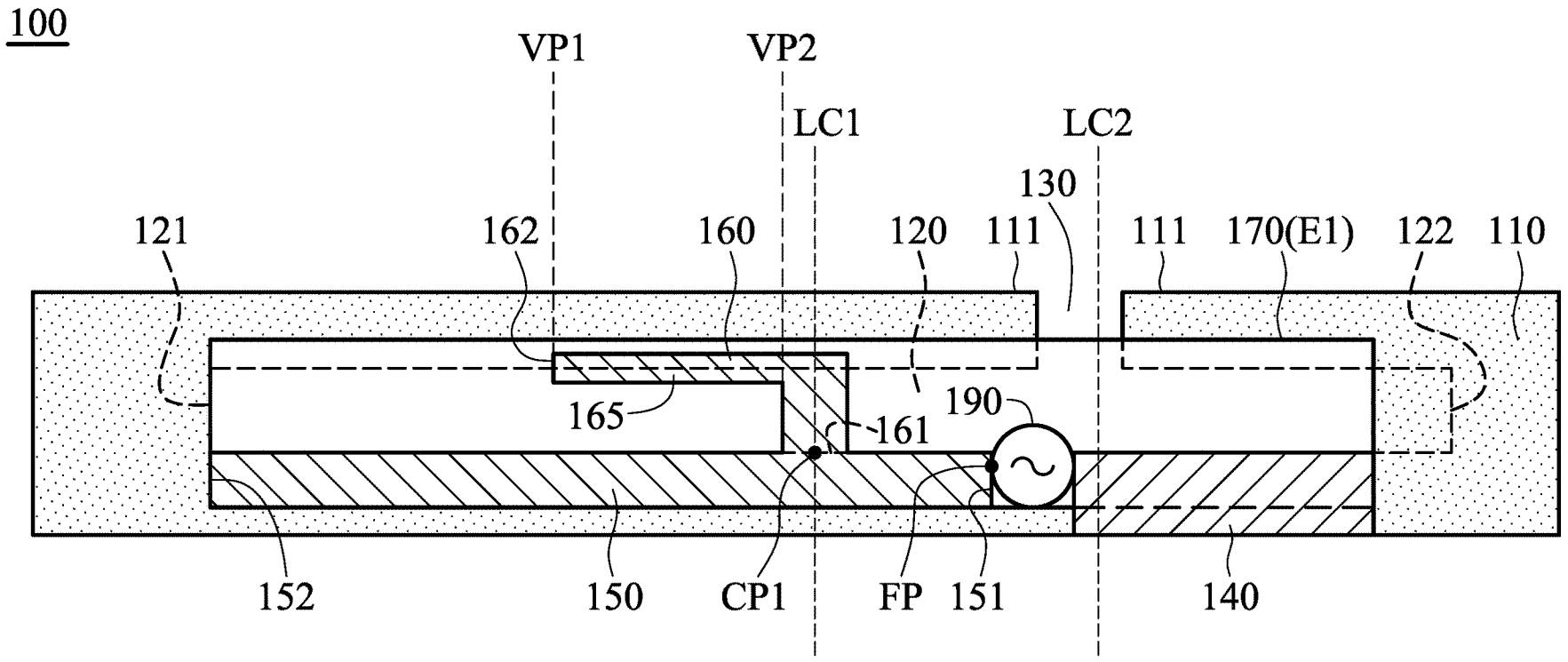
FIG. 1A is a top view of an antenna structure according to an embodiment of the invention.
Figure 1B:
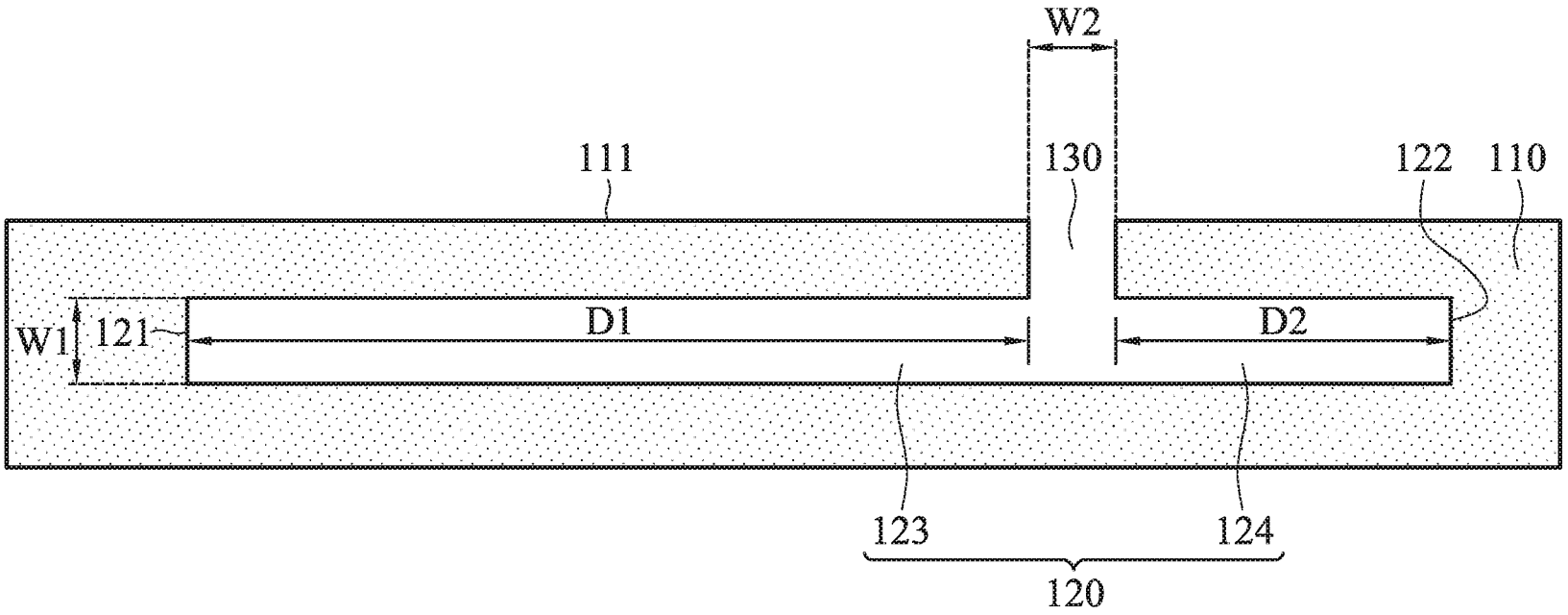
FIG. 1B is a top view of a metal mechanism element according to an embodiment of the invention.
Figure 1D:
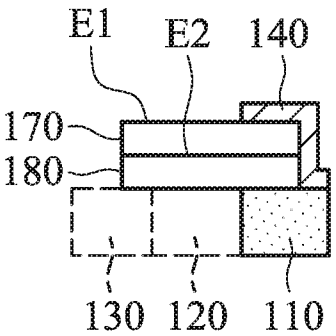
FIG. 1D is a sectional view of an antenna structure according to an embodiment of the invention.
Figure 1C:
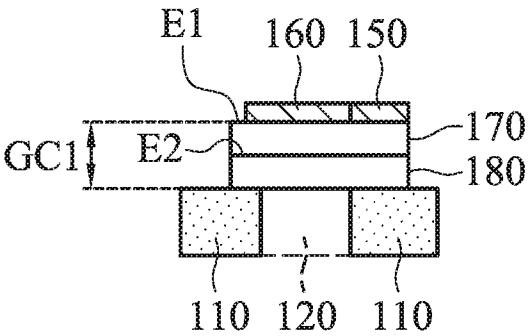
FIG. 1C is a sectional view of an antenna structure according to an embodiment of the invention.

FIG. 1A is a top view of an antenna structure 100 according to an embodiment of the invention. The antenna structure 100 may be applied in a mobile device, such as a smartphone, a tablet computer, or a notebook computer. In the embodiment of FIG. 1A, the antenna structure 100 at least includes a metal mechanism element 110, a ground element 140, a first radiation element 150, a second radiation element 160, and a dielectric substrate 170. The ground element 140, the first radiation element 150, and the second radiation element 160 may be made of metal materials, such as copper, silver, aluminum, iron, or their alloys. FIG. 1B is a top view of the metal mechanism element 110 according to an embodiment of the invention. FIG. 1C is a sectional view of the antenna structure 100 according to an embodiment of the invention (along a sectional line LC1 of FIG. 1A). FIG. 1D is a sectional view of the antenna structure 100 according to an embodiment of the invention (along another sectional line LC2 of FIG. 1A). Please refer to FIG. 1A, FIG. 1B, FIG. 1C, and FIG. 1D to understand the invention.

The metal mechanism element 110 may be a sidewall of the mobile device. In some embodiments, the metal mechanism element 110 is coupled between a frame and a housing of a body of the mobile device, but it is not limited thereto. The metal mechanism element 110 has a slot 120. A notch 130 is formed on an edge 111 of the metal mechanism element 110. The notch 130 and the slot 120 are connected to each other (i.e., the slot 120 is exposed from the edge 111 through the notch 130), such that a combination of the notch 130 and the slot 120 may substantially have an inverted T-shape. The slot 120 of the metal mechanism element 110 may substantially have a straight-line shape. Specifically, the slot 120 is a closed slot whose two ends are closed, and the slot 120 has a first closed end 121 and a second closed end 122 which are away from each other. The slot 120 is divided into a long portion 123 and a short portion 124 by the notch 130. The long portion 123 is adjacent to the first closed end 121. The short portion 124 is adjacent to the second closed end 122. In some embodiments, the antenna structure 100 further include a nonconductive material (not shown), which fills the slot 120 and the notch 130 of the metal mechanism element 110.

The dielectric substrate 170 may be an FR4 (Flame Retardant 4) substrate, a PCB (Printed Circuit Board), or an FCB (Flexible Circuit Board). The dielectric substrate 170 has a first surface E1 and a second surface E2 which are opposite to each other. The first radiation element 150 and the second radiation element 160 are both disposed on the first surface E1 of the dielectric substrate 170. The second surface E2 of the dielectric substrate 170 is adjacent to the slot 120 of the metal mechanism element 110. It should be noted that the term "adjacent" or "close" over the disclosure means that the distance (spacing) between two corresponding elements is shorter than a predetermined distance (e.g., 5 mm or shorter), or that the two corresponding elements directly touch each other (i.e., the aforementioned distance/spacing therebetween is reduced to 0).

In some embodiments, the antenna structure 100 further includes a plastic supporting element 180. The plastic supporting element 180 is disposed on the metal mechanism element 110 and is configured to support and fix the dielectric substrate 170. It should be noted that the plastic supporting element 180 is an optional element. In alternative embodiments, the plastic supporting element 180 is removed from the antenna structure 100, and the second surface E2 of the dielectric substrate 170 is directly attached to the metal mechanism element 110. The ground element 140 may be a ground copper foil, which may substantially have a stepped-shape (as shown in FIG. 1D). For example, the ground element 140 may be coupled to the metal mechanism element 110, and the ground element 140 may extend from the metal mechanism element 110 onto the first surface E1 of the dielectric substrate 170.

The first radiation element 150 may substantially have a straight-line shape, and it may be substantially parallel to the slot 120. The first radiation element 150 has a first end 151 and a second end 152 which are away from each other. A feeding point FP is positioned at the first end 151 of the first radiation element 150. The second end 152 of the first radiation element 150 is an open end. The feeding point FP is coupled to a positive electrode of a signal source 190, and a negative electrode of the signal source 190 is coupled to the ground element 140. For example, the signal source 190 may be an RF (Radio Frequency) module for exciting the antenna structure 100. The first radiation element 150 may be an equal-width structure. The first radiation element 150 has a vertical projection on the metal mechanism element 110. In some embodiments, the vertical projection of the first radiation element 150 does not overlap the slot 120 at all. In alternative embodiments, the vertical projection of the first radiation element 150 at least partially overlaps the slot 120.

The second radiation element 160 may substantially have an L-shape. The second radiation element 160 has a first end 161 and a second end 162. The first end 161 of the second radiation element 160 is coupled to a first connection point CP1 on the first radiation element 150. The second end 162 of the second radiation element 160 is an open end. The first connection point CP1 is positioned between the first end 151 and the second end 152 of the first radiation element 150. The first connection point CP1 is closer to the first end 151 than the second end 152. In alternative embodiments, adjustments are made such that the first connection point CP1 is farther away from the first end 151 than the second end 152. The second end 152 of the first radiation element 150 and the second end 162 of the second radiation element 160 may substantially extend in the same direction. The second radiation element 160 may be partially perpendicular to the first radiation element 150, and may be partially parallel to the first radiation element 150. The second radiation element 160 extends across the slot 120 of the metal mechanism element 110. That is, the second radiation element 160 has a vertical projection (i.e., the area between VP1 and VP2) on the metal mechanism element 110, and the vertical projection of the second radiation element 160 at least partially overlaps the slot 120 (as shown in FIG. 1A). In some embodiments, the second radiation element 160 includes a first extension portion 165 which is substantially parallel to the slot 120. The first extension portion 165 of the second radiation element 160 has a vertical projection on the metal mechanism element 110, and the vertical projection of the first extension portion 165 at least partially overlaps the slot 120.

Figure 2:
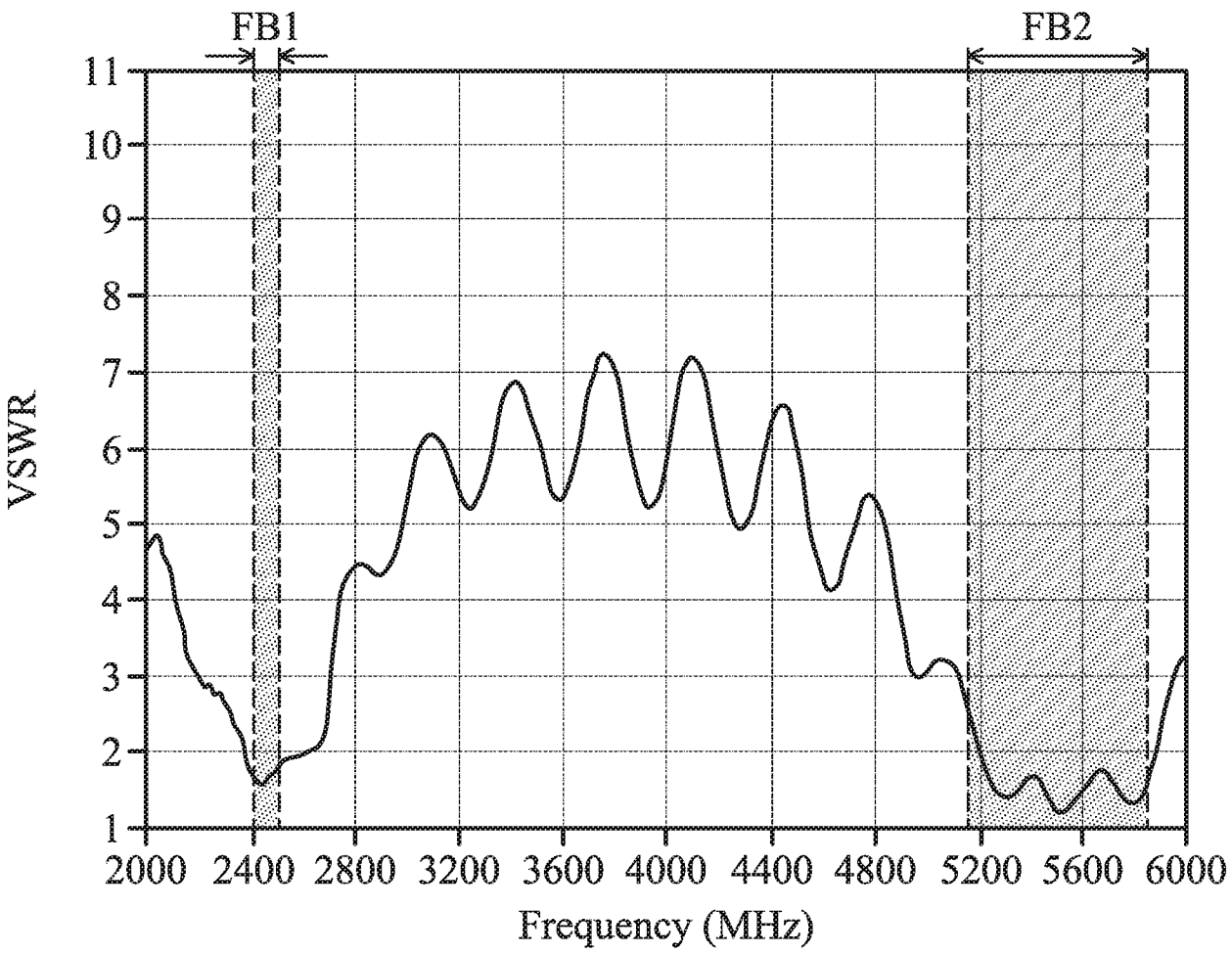
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. As shown in FIG. 2, the antenna structure 100 can operate in a first frequency band FB1 and a second frequency band FB2. The first frequency band FB1 may be from 2400 MHz to 2500 MHz. The second frequency band FB2 may be from 5150 MHz to 5850 MHz. Therefore, the antenna structure 100 can support at least the wideband operations of WLAN (Wireless Local Area Networks) 2.4 GHz/5 GHz. According to practical measurements, the radiation efficiency of the antenna structure 100 is about −1.94 dB within the first frequency band FB1, and the radiation efficiency of the antenna structure 100 is about −4.18 dB within the second frequency band FB2. It can meet the requirements of practical application of general mobile communication devices.

In some embodiments, the operation principles of the antenna structure 100 are described as follows. The metal mechanism element 110 and its slot 120 are excited by the first radiation element 150 and the second radiation element 160, thereby forming the above dual operation frequency bands. Specifically, the long portion 123 of the slot 120 is positioned between the notch 130 and the first closed end 121, and it is excited to generate the first frequency band FB1; and the short portion 124 of the slot 120 is positioned between the notch 130 and the second closed end 122, and it is excited to generate the second frequency band FB2. The first radiation element 150 is configured to fine-tune the impedance matching of the first frequency band FB1. The second radiation element 160 is configured to fine-tune the impedance matching of the second frequency band FB2. According to practical measurements, the incorporation of the notch 130 can effectively reduce the total length of the slot 120 (the total length is reduced by 25% in comparison to the conventional design), and such a design helps to minimize the total size of the antenna structure 100.

In some embodiments, the element sizes of the antenna structure 100 are described as follows. A specific resonant path is formed from the feeding point FP through the first connection point CP1 to the second end 162 of the second radiation element 160, and the total length of the specific resonant path may be from 11 mm to 15.5 mm. A first distance D1 is defined between the notch 130 and the first closed end 121 of the slot 120 (i.e., the length of the long portion 123 of the slot 120). The first distance D1 may be substantially equal to 0.25 wavelength (λ/4) of the first frequency band FB1. A second distance D2 is defined between the notch 130 and the second closed end 122 of the slot 120 (i.e., the length of the short portion 124 of the slot 120). The second distance D2 may be substantially equal to 0.25 wavelength (λ/4) of the second frequency band FB2. The ratio of the first distance D1 to the second distance D2 (i.e., D1/D2) may be from 2 to 3. A coupling gap GC1 is formed between the metal mechanism element 110 and the second radiation element 160 (or the first radiation element 150). The width of the coupling gap GC1 may be less than 3 mm. The length of the first radiation element 150 (i.e., the length from the first end 151 to the second end 152) may be from 15 mm to 20 mm (e.g., about 17.5 mm). The length of the second radiation element 160 (i.e., the length from the first end 161 to the second end 162) may be from 8 mm to 12 mm (e.g., about 10 mm). The width W1 of the slot 120 may be from 2 mm to 2.5 mm. The width W2 of the notch 130 may be from about 1 mm to about 3 mm. The above ranges of element parameters are calculated and obtained according to the results of many experiments, and they help to optimize the operation bandwidth and impedance matching of the antenna structure 100.

Figure 3:
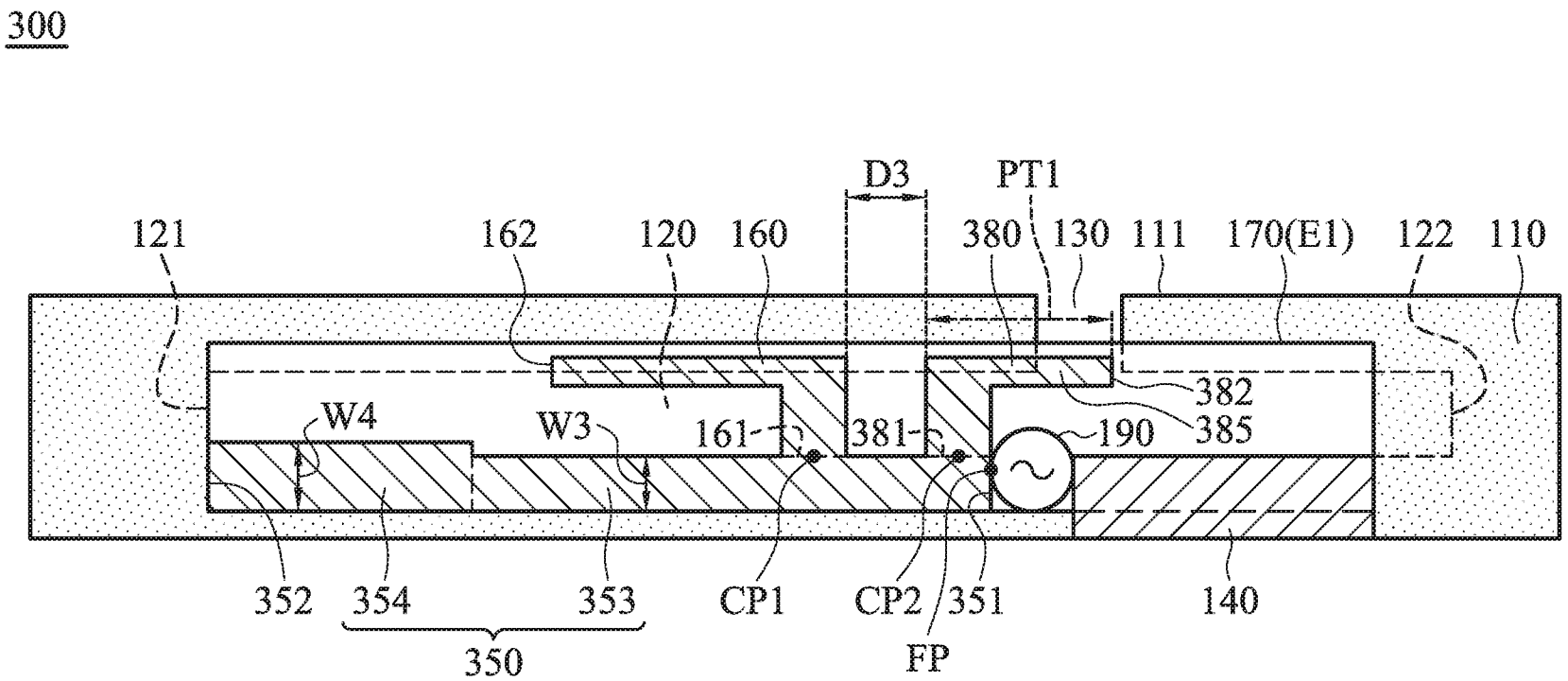
FIG. 3 is a top view of an antenna structure according to another embodiment of the invention.

FIG. 3 is a top view of an antenna structure 300 according to another embodiment of the invention. FIG. 3 is similar to FIG. 1A. In the embodiment of FIG. 3, the antenna structure 300 further includes a third radiation element 380 made of a metal material, and a first radiation element 350 of the antenna structure 300 has a variable-width structure. The third radiation element 380 may substantially have an L-shape. The third radiation element 380 has a first end 381 and a second end 382. The first end 381 of the third radiation element 380 is coupled to a second connection point CP2 on the first radiation element 350. The second end 382 of the third radiation element 380 is an open end. The second connection point CP2 is different from the aforementioned first connection point CP1. The second connection point CP2 is adjacent to the feeding point FP. The second end 382 of the third radiation element 380 and the second end 162 of the second radiation element 160 may substantially extend in opposite directions. The third radiation element 380 may be partially perpendicular to the first radiation element 350, and may be partially parallel to the first radiation element 350. The third radiation element 380 extends across the slot 120 of the metal mechanism element 110. In addition, the third radiation element 380 has a vertical projection PT1 on the edge 111 of the metal mechanism element 110, and the vertical projection PT1 of the third radiation element 380 may at least partially overlap the notch 130. In some embodiments, the second end 382 of the third radiation element 380 further extends across the whole notch 130. The length of the third radiation element 380 (i.e., the length from the first end 381 to the second end 382) may be from 5 mm to 10 mm (e.g., about 7 mm). The length of the first radiation element 350 may be longer than the length of the second radiation element 160. The length of the second radiation element 160 may be longer than the length of the third radiation element 380. A third distance D3 is defined between the third radiation element 380 and the second radiation element 160. The third distance D3 may be from 1 mm to 3 mm (e.g., 2 mm). In some embodiments, the third radiation element 380 includes a second extension portion 385 which is substantially parallel to the slot 120. The second extension portion 385 of the third radiation element 380 has a vertical projection on the metal mechanism element 110, and the vertical projection of the second extension portion 385 at least partially overlaps the slot 120.

The first radiation element 350 has a first end 351 and a second end 352 and includes a narrow portion 353 and a wide portion 354. The narrow portion 353 is adjacent to the first end 351. The wide portion 354 is adjacent to the second end 352. Specifically, the narrow portion 353 of the first radiation element 350 has a vertical projection on the metal mechanism element 110, and the vertical projection of the narrow portion 353 does not overlap the slot 120 at all. The wide portion 354 of the first radiation element 350 has a vertical projection on the metal mechanism element 110, and the vertical projection of the wide portion 354 at least partially overlaps the slot 120. The width W3 of the narrow portion 353 of the first radiation element 350 may be from about 1 mm to about 1.5 mm (e.g., 1.2 mm). The width W4 of the wide portion 354 of the first radiation element 350 may be from about 1.5 mm to about 2 mm (e.g., 1.7 mm). The ratio of the width W4 to the width W3 (i.e., W4/W3) may be from 1.2 to 2. The above ranges of element parameters are calculated and obtained according to the results of many experiments, and they help to optimize the operation bandwidth and impedance matching of the antenna structure 300.

Figure 4:
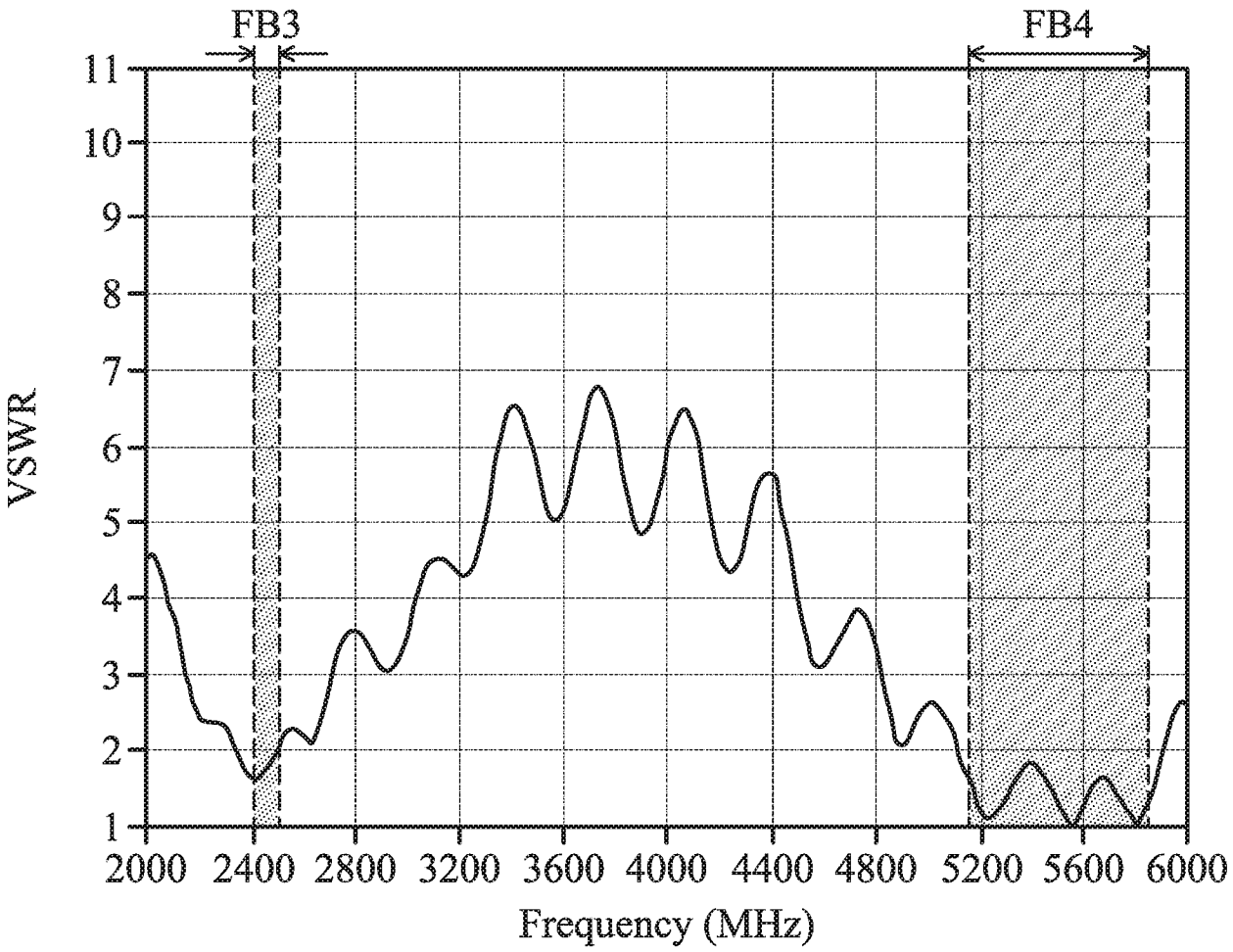
FIG. 4 is a diagram of VSWR of an antenna structure according to another embodiment of the invention.

FIG. 4 is a diagram of VSWR of the antenna structure 300 according to another embodiment of the invention. As shown in FIG. 4, the antenna structure 400 can operate in a first frequency band FB3 and a second frequency band FB4. The first frequency band FB3 may be from 2400 MHz to 2500 MHz. The second frequency band FB4 may be from 5150 MHz to 5850 MHz. Therefore, the antenna structure 300 can support at least the wideband operations of WLAN 2.4 GHz/5 GHz. According to practical measurements, the radiation efficiency of the antenna structure 300 is about −2 dB within the first frequency band FB3, and the radiation efficiency of the antenna structure 300 is about −2.4 dB within the second frequency band FB4. It can meet the requirements of practical application of general mobile communication devices. With respect to the antenna principles, the variable-width structure of the first radiation element 350 provides additional current paths so as to increase the operation bandwidth and radiation efficiency of the first frequency band FB3, and the incorporation of the third radiation element 380 generates additional resonant modes so as to increase the operation bandwidth and radiation efficiency of the second frequency band FB4. Other features of the antenna structure 300 of FIG. 3 are similar to those of the antenna structure 100 of FIG. 1A, FIG. 1B, FIG. 1C and FIG. 1D. Accordingly, the two embodiments can achieve similar levels of performance.

Figure 5:
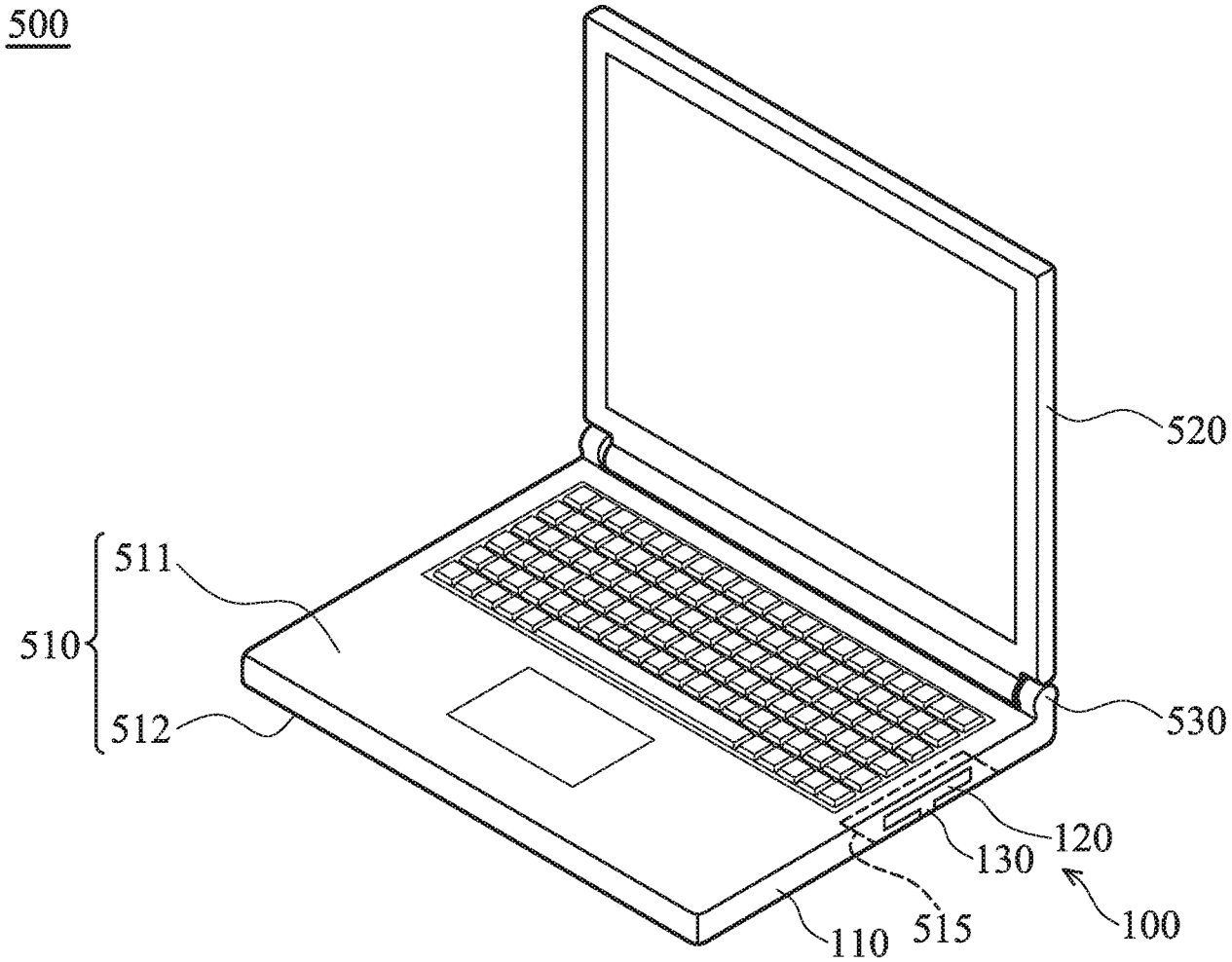
FIG. 5 is a perspective view of a mobile device according to an embodiment of the invention.

FIG. 5 is a perspective view of a mobile device 500 according to an embodiment of the invention. In the embodiment of FIG. 5, the mobile device 500 is a notebook computer including a body 510, an upper cover 520, and a hinge element 530. The hinge element 530 is connected between the body 510 and the upper cover 520, such that the mobile device 500 operates in an open mode or a closed mode. Specifically, the body 510 includes a frame 511 and a housing 512 which are opposite to each other. The frame 511 and the housing 512 are considered as the so-called "C-component" and "D-component" in the field of notebook computers, respectively. The frame 511 may be a keyboard frame, and a keyboard may be embedded in the frame 511. The metal mechanism element 110 may be a sidewall of the mobile device 500. The metal mechanism element 110 may be coupled between the frame 511 and the housing 512, such that the aforementioned antenna structure 100 (or 300) can be integrated with the mobile device 500. The structure and function of the antenna structure 100 (or 300) have been described in the embodiments of FIGS. 1 to 4, and they will not be illustrated again here. In some embodiments, an antenna window 515 is opened on the housing 512, and a nonconductive material fills the antenna window 515. The antenna window 515 can prevent the metal portions of the housing 512 from interfering with the radiation pattern of the antenna structure 100 (or 300). Such an integrating design can fully use the side space of the mobile device 500, thereby minimizing the total antenna size.

Figure 6:
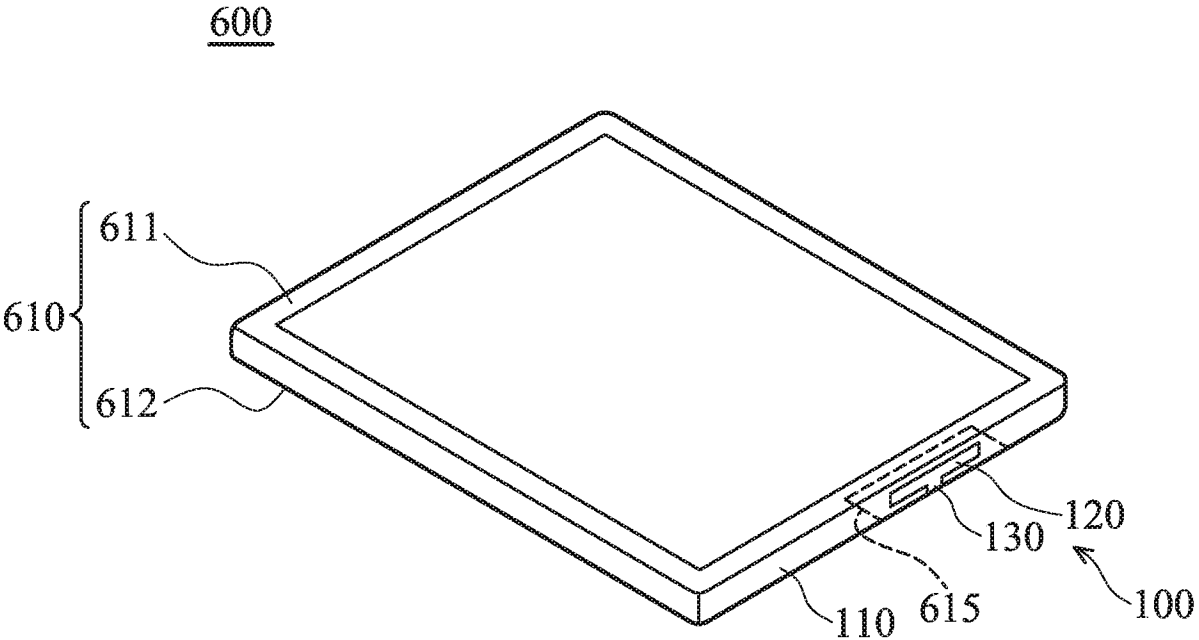
FIG. 6 is a perspective view of a mobile device according to another embodiment of the invention.

FIG. 6 is a perspective view of a mobile device 600 according to another embodiment of the invention. In the embodiment of FIG. 6, the mobile device 600 is a tablet computer including a body 610. Specifically, the body 610 includes a frame 611 and a housing 612 which are opposite to each other. The frame 611 may be a display frame, and a display device may be embedded in the frame 611. The metal mechanism element 110 may be a sidewall of the mobile device 600. The metal mechanism element 110 may be coupled between the frame 611 and the housing 612, such that the aforementioned antenna structure 100 (or 300) can be integrated with the mobile device 600. The structure and function of the antenna structure 100 (or 300) have been described in the embodiments of FIGS. 1 to 4, and they will not be illustrated again here. In some embodiments, the housing 612 further has an antenna window 615, and a nonconductive material fills the antenna window 615. The antenna window 615 can prevent the metal portions of the housing 612 from interfering with the radiation pattern of the antenna structure 100 (or 300). Such an integrating design can fully use the side space of the mobile device 600, thereby minimizing the total antenna size.

The invention proposes a novel antenna structure, which uses a single slot with a notch for covering wideband operations. When the antenna structure is applied to a mobile device including a metal mechanism element, the metal mechanism element does not negatively affect the radiation performance of the antenna structure because the metal mechanism element is considered as an extension portion of the antenna structure. In conclusion, the invention has at least the advantages of small size, wide bandwidth, and beautiful device appearance, and therefore it is suitable for application in a variety of mobile communication devices with narrow borders.

Note that the above element sizes, element shapes, and frequency ranges are not limitations of the invention. An antenna designer can fine-tune these settings or values according to different requirements. It should be understood that the antenna structure and the mobile device of the invention are not limited to the configurations of FIGS. 1-6. The invention may merely include any one or more features of any one or more embodiments of FIGS. 1-6. In other words, not all of the features displayed in the figures should be implemented in the antenna structure and the mobile device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a metal mechanism element, having a slot, wherein a notch is formed on an edge of the metal mechanism element, and the slot is exposed from the edge through the notch;

a ground element, coupled to the metal mechanism element;

a first radiation element, having a feeding point;

a second radiation element, coupled to the first radiation element, and comprising a first extension portion, wherein the second radiation element extends across the slot, the first extension portion is parallel to the slot, the first extension portion has a vertical projection on the metal mechanism element, and the vertical projection of the first extension portion at least partially overlaps the slot; and a dielectric substrate, disposed adjacent to the metal mechanism element, wherein the first radiation element and the second radiation element are disposed on the dielectric substrate.

2. The antenna structure as claimed in claim 1, wherein the metal mechanism element is a sidewall of a mobile device.

3. The antenna structure as claimed in claim 2, wherein the mobile device is a notebook computer.

4. The antenna structure as claimed in claim 1, wherein the slot substantially has a straight-line shape.

5. The antenna structure as claimed in claim 1, wherein the slot is a closed slot with a first closed end and a second closed end.

6. The antenna structure as claimed in claim 1, wherein the ground element is a ground copper foil extending from the metal mechanism element onto the dielectric substrate.

7. The antenna structure as claimed in claim 1, wherein the first radiation element substantially has a straight-line shape.

8. The antenna structure as claimed in claim 1, wherein the first radiation element has a variable-width structure.

9. The antenna structure as claimed in claim 8, wherein the first radiation element comprises a narrow portion and a wide portion, the wide portion has a vertical projection on the metal mechanism element, and the vertical projection of the wide portion at least partially overlaps the slot.

10. The antenna structure as claimed in claim 1, wherein the second radiation element substantially has an L-shape.

11. The antenna structure as claimed in claim 1, further comprising:

a third radiation element, coupled to the first radiation element, wherein the third radiation element extends across the slot and comprises a second extension portion, the second extension portion is parallel to the slot, the second extension portion has a vertical projection on the metal mechanism element, and the vertical projection of the second extension portion at least partially overlaps the slot.

12. The antenna structure as claimed in claim 11, wherein the third radiation element substantially has an L-shape.

13. The antenna structure as claimed in claim 11, wherein the second radiation element and the third radiation element substantially extend in opposite directions.

14. The antenna structure as claimed in claim 11, wherein the third radiation element has a vertical projection on the edge of the metal mechanism element, and the vertical projection of the third radiation element at least partially overlaps the notch.

15. The antenna structure as claimed in claim 5, wherein the antenna structure operates in a first frequency band and a second frequency band, the first frequency band is from 2400 MHz to 2500 MHz, and the second frequency band is from 5150 MHz to 5850 MHz.

16. The antenna structure as claimed in claim 15, wherein a first distance is defined between the notch and the first closed end of the slot, and the first distance is substantially equal to 0.25 wavelength of the first frequency band.

17. The antenna structure as claimed in claim 15, wherein a second distance is defined between the notch and the second closed end of the slot, and the second distance is substantially equal to 0.25 wavelength of the second frequency band.

18. The antenna structure as claimed in claim 1, wherein a width of the notch is from 1 mm to 3 mm.

19. A mobile device, comprising:

a body, comprising a frame and a housing;

a metal mechanism element, coupled between the frame and the housing, and having a slot, wherein a notch is formed on an edge of the metal mechanism element, and the slot is exposed from the edge through the notch;

a ground element, coupled to the metal mechanism element;

a first radiation element, having a feeding point;

a second radiation element, coupled to the first radiation element, and comprising a first extension portion, wherein the second radiation element extends across the slot, the first extension portion is parallel to the slot, the first extension portion has a vertical projection on the metal mechanism element, and the vertical projection of the first extension portion at least partially overlaps the slot; and a dielectric substrate, disposed adjacent to the metal mechanism element, wherein the first radiation element and the second radiation element are disposed on the dielectric substrate;

wherein an antenna structure is formed by the metal mechanism element, the ground element, the first radiation element, the second radiation element, and the dielectric substrate.

20. The mobile device as claimed in claim 19, wherein an antenna window is opened on the housing.

* * * * *